US011345162B2

(12) United States Patent
Govyadinov et al.

(10) Patent No.: US 11,345,162 B2
(45) Date of Patent: May 31, 2022

(54) FLUID RECIRCULATION CHANNELS

(71) Applicant: HEWLETT-PACKARD DEVELOPMENT COMPANY, L.P., Houston, TX (US)

(72) Inventors: Alexander Govyadinov, Corvallis, OR (US); Ron Burns, San Diego, CA (US); Erik D. Torniainen, Corvallis, OR (US); Galen P. Cook, Corvallis, OR (US); David P. Markel, Corvallis, OR (US); Garrard Hume, San Diego, CA (US); Chris Bakker, Aguadilla, PR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 163 days.

(21) Appl. No.: 15/570,634

(22) PCT Filed: Jul. 14, 2015

(86) PCT No.: PCT/US2015/040411
§ 371 (c)(1),
(2) Date: Oct. 30, 2017

(87) PCT Pub. No.: WO2017/010996
PCT Pub. Date: Jan. 19, 2017

(65) Prior Publication Data

US 2018/0290458 A1 Oct. 11, 2018

(51) Int. Cl.
*B41J 2/175* (2006.01)
*B41J 29/02* (2006.01)
(Continued)

(52) U.S. Cl.
CPC ..... *B41J 2/17596* (2013.01); *B41J 2/1404* (2013.01); *B41J 2/1433* (2013.01);
(Continued)

(58) Field of Classification Search
None
See application file for complete search history.

(56) References Cited

U.S. PATENT DOCUMENTS 4,460,904 A 7/1984 Oszczakiewicz et al.
5,818,485 A 10/1998 Rezanka
(Continued)

FOREIGN PATENT DOCUMENTS

JP 2000 318188 A 11/2000
JP 2006 272614 A 10/2006
(Continued)

OTHER PUBLICATIONS

Electrical Analogies Applied on a Volumetric Micropump "Highlighting of its Fluidic Resonant Frequency" CPA Patentability Search Report.

*Primary Examiner* — Alejandro Valencia
(74) *Attorney, Agent, or Firm* — Middleton Reutlinger

(57) ABSTRACT

A fluid recirculation channel for dispensing a plurality of fluid drop weights includes a number of sub-channels. The sub-channels include at least one pump channel, and a plurality of drop generator channels fluidically coupled to the at least one pump channel. The fluid recirculation channel further includes a number of pump generators incorporated into the at least one pump channel, a number of drop generators incorporated into drop generator channels, and a plurality of nozzles defined within the drop generator channels, the nozzles being at least as numerous as the number of drop generators.

13 Claims, 7 Drawing Sheets

(51) Int. Cl.
*B41J 2/14* (2006.01)
*B41J 2/18* (2006.01)

(52) U.S. Cl.
CPC ..... *B41J 2/14145* (2013.01); *B41J 2/18* (2013.01); *B41J 29/02* (2013.01); *B41J 2002/14403* (2013.01); *B41J 2002/14467* (2013.01); *B41J 2002/14475* (2013.01); *B41J 2202/11* (2013.01); *B41J 2202/12* (2013.01)

(56) References Cited

U.S. PATENT DOCUMENTS 6,328,399 B1 12/2001 Wen
6,431,694 B1 8/2002 Ross
7,040,745 B2 5/2006 Kent
7,207,655 B2 4/2007 Delametter
7,625,065 B2 * 12/2009 Kanda ..... B41J 2/1433 347/15
8,540,355 B2 9/2013 Govyadinov
8,622,522 B2 1/2014 Saito et al.
8,651,646 B2 2/2014 Govyadinov
8,721,061 B2 5/2014 Govyadinov
8,757,783 B2 6/2014 Govyadinov
8,814,293 B2 8/2014 Strunk et al.
2006/0050107 A1 * 3/2006 Yamanaka ..... B41J 2/1433 347/40
2008/0136872 A1 6/2008 Tsuchii et al.
2008/0143786 A1 * 6/2008 Oikawa ..... B41J 2/1404 347/47
2012/0007921 A1 1/2012 Govyadinov et al.
2013/0021411 A1 * 1/2013 Feinn ..... B41J 2/14016 347/47
2013/0057622 A1 3/2013 Govyadinov et al.
2013/0141490 A1 6/2013 Kodoi
2013/0155152 A1 6/2013 Govyadinov et al.
2013/0182022 A1 7/2013 Strunk et al.
2015/0085021 A1 * 3/2015 Govyadinov ..... B41J 2/175 347/63
2015/0091989 A1 * 4/2015 Govyadinov ..... B41J 2/04541 347/89

FOREIGN PATENT DOCUMENTS

JP 2008-162270 A 7/2008
JP 2013-526441 A 6/2013
JP 2013-544678 A 12/2013
JP 2013244714 12/2013
JP 2015003433 1/2015
WO PCT-2014003772 1/2014
WO WO 2016/175865 A1 11/2016

* cited by examiner

FLUID RECIRCULATION CHANNELS

BACKGROUND

Fluid ejection devices in inkjet printers provide drop-on-demand ejection of fluid drops. Inkjet printers produce images by ejecting ink drops through a plurality of nozzles onto a print medium, such as a sheet of paper. The nozzles may be arranged in a number of arrays, such that properly sequenced ejection of ink drops from the nozzles causes characters or other images to be printed on the print medium as the printhead and the print medium move relative to each other. In one example, a thermal inkjet printhead ejects drops from a nozzle by passing electrical current through a heating element to generate heat and vaporize a small portion of the fluid within a firing chamber. In another example, a piezoelectric inkjet printhead uses a piezoelectric material actuator to generate pressure pulses that force ink drops out of a nozzle.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1:
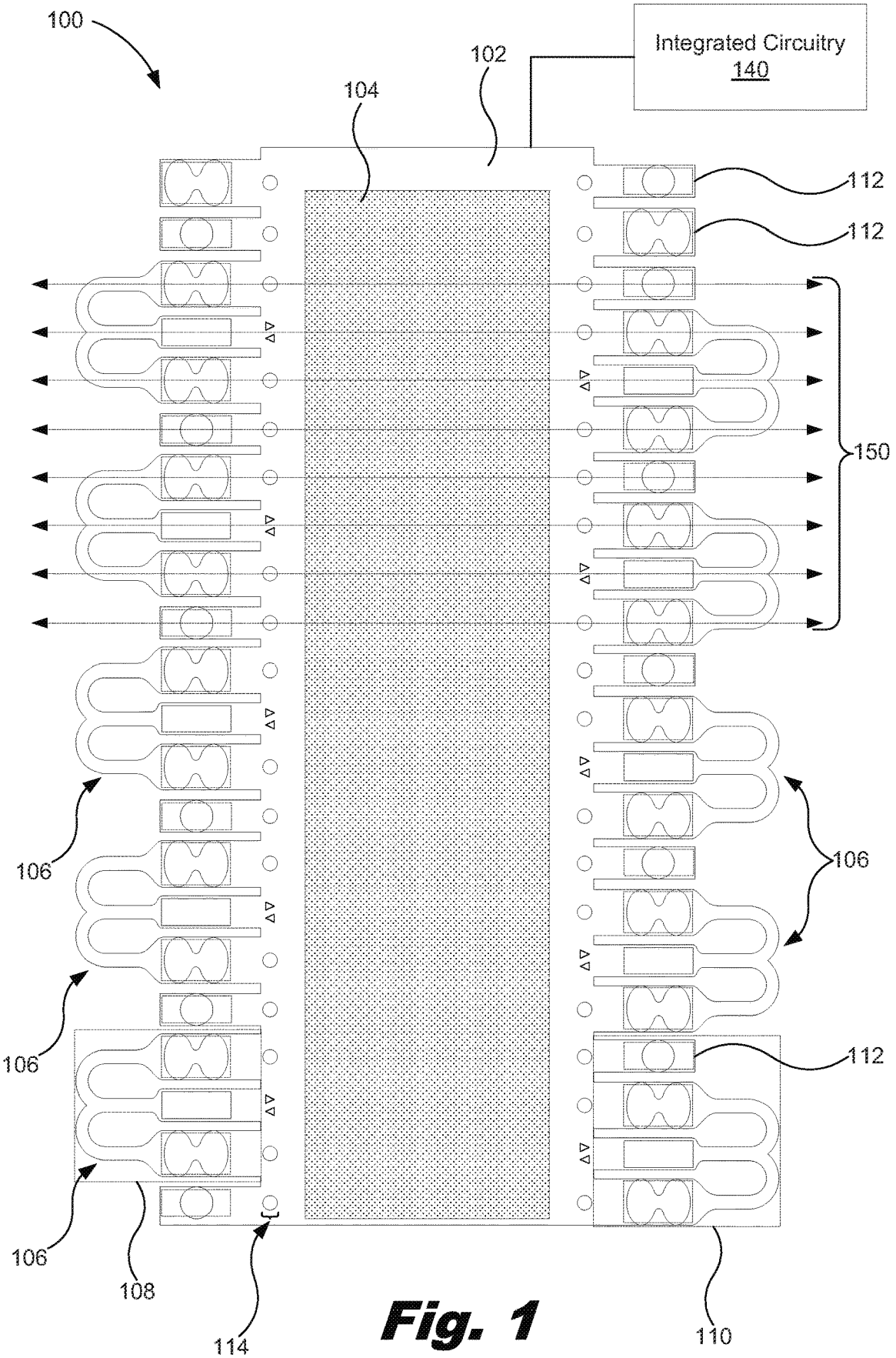
FIG. 1 is a diagram of a top view of a fluid ejection assembly including a number of fluid recirculation channels, according to one example of the principles described herein.

Although inkjet printers provide high print quality at reasonable cost, continued improvement in inkjet printing allows for even higher quality printing at similar or lower costs to a user. These advances in inkjet printing may alleviate or eliminate disadvantageous processes and occurrences within inkjet printing devices that degrade print quality. For example, during printing, air from jettable materials such as ink is released and forms bubbles that may migrate from the firing chamber of the printhead to other locations in the printhead. This migration of bubbles block ink flow, degrade the print quality, cause partly full print cartridges to appear empty, and cause ink leakage within the system.

In addition, pigment-ink vehicle separation (PIVS), when using pigment-based inks, may also degrade the print quality. Pigment-based inks may be used in inkjet printing, as they tend to be more durable and permanent than dye-based inks. However, during periods of storage or non-use, pigment particles may settle or crash out of the ink vehicle. This PIVS may impede or completely block ink flow to the firing chambers and nozzles in the printheads. Other factors such as evaporation of water in aqueous inks and evaporation of solvent in non-aqueous inks may also contribute to PIVS and/or increased ink viscosity and viscous plug formation, which may, in turn, prevent immediate printing after periods of non-use.

The above factors may lead to "decap" which may be defined as an amount of time inkjet nozzles remain uncapped and exposed to ambient environments without causing degradation in the ejected ink drops. Effects of decap may alter drop ejection trajectories, velocities, shapes, and colors, all of which may negatively impact the print quality of an inkjet printer.

Examples described herein provide a fluid recirculation channel for dispensing a plurality of fluid drop weights. The fluid recirculation channel may include a number of sub-channels. The number of sub-channels may include at least one pump channel, and a plurality of drop generator channels fluidically coupled to the at least one pump channel. A number of pumps may be incorporated into the at least one pump channel. Further, a number of drop generators incorporated into drop generator channels. Still further, a number of pump generators may be incorporated into the at least one pump channel.

The fluid recirculation channel may further include a plurality of nozzles defined within the drop generator channels. The nozzles may be at least as numerous as the number of drop generators. Further, the nozzles may include at least two different nozzles that emit at least two different drop weights of fluid. The two different drop weights may include a first drop weight and a second drop weight wherein the second drop weight includes a drop weight that is relatively higher than the first drop weight.

In one example, the fluid recirculation channel includes an N:1 drop generator to pump generator ratio, wherein N is at least 1. In another example, the fluid recirculation channel includes an N:1 drop generator to pump generator ratio, wherein N is at least 2. Further, in one example, the number of pumps included in the fluid recirculation channel may be defined by the number of pump channels within the fluid recirculation channel. Still further, in one example, the number of drop generators may be defined by the number of drop generator channels within the fluid recirculation channel.

The examples described herein provide relatively higher effective nozzle density without physical inclusion of smaller or more abundant nozzles per slot inch (npsi). Further, the examples described herein provide a relatively higher resolution of printed images than systems that do not incorporate the present fluid recirculation channels. Specifically, in one example, the fluid recirculation channels provide up to 1800 npsi with recirculation capability which is a 1.5 to 3 times higher effective nozzle density than systems that do not utilize these examples. Npsi is determined by the existence of drive circuits such as field-effect transistors (FETs) available within the system. Examples described herein provide high density (HD) silicon circuits that enable 2400 npsi. The use of recirculation pumps within the examples described herein reduce the number of available FETs that may otherwise be used to drive the pump generators. In other words, the use of recirculation pumps within the examples described herein reduces the npsi as the FETs that may be utilized by the drop generators are instead utilized by the pump generators. Despite this reallocation of FETs to the pump generators, the use of the recirculation channels and their respective pump generators enables difficult-to-jet inks with a minimal loss of npsi or nozzles allocated to printing. The examples described herein provides recirculation configurations with a single pump generator servicing multiple nozzles located within a number of fluidically-coupled drop generator channels. This configuration may be contrasted to a single pump generator per nozzle. Thus, the degree or amount of npsi loss is reduced compared to a 1:1 drop generator to pump generator ratio configuration. The recirculation configurations described herein produces a loss in npsi, but provides a N:1 drop generator to pump generator ratio configuration that reduces that loss in npsi to a degree while adding the benefit of the recirculation of ink within the fluid recirculation channels.

Recirculation within the fluid recirculation channels described herein overcome low ink flux issues and enable 25-50 percent higher ink flux of decap susceptible inks. The recirculation of fluid during both idle time and active operation of the fluid ejection assembly helps to prevent ink blockage or clogging in inkjet printheads. Further, use of the recirculation of fluid through the fluid recirculation channels described herein allows for inks that include high solid loads such as ultraviolet (UV) curable inks to be used within the printheads. Thus, recirculation within the fluid recirculation channels described herein overcome decap issues that may arise due to PIVS and the formation of viscous plugs within the printheads and nozzles.

Still further, the fluid recirculation channels described herein also eliminate the need for ink spitting used to decap the nozzles in preparation for printing. Due to the recirculation of fluid during both idle time and active operation of the fluid ejection assembly, a relatively shorter decap time of high solid load inks may be realized. In one example, the fluid recirculation channels described herein significantly lower the decap time for even high solid load inks eliminating the need for ink spitting for decap recovery purposes. This decap recovery allows for the use of high efficiency inks within the printing system. Thus, the examples described herein are useful in a wider array of printing scenarios and in connection with a wider array of ink types, and, in turn, are able to be used by a larger number of customers desiring high quality printing. In connection with the elimination of ink spitting due to the recirculation of fluid during both idle time and active operation of the fluid ejection assembly, the examples described herein provide a higher ink efficiency by not requiring ink spitting during servicing before and during operation.

Still further, examples described herein also reduce or eliminate ink spitting on the media often called spit-on-page. Without the fluid recirculation channels described herein, a printing system may waste ink and lower the quality of the printed image by spitting or ejecting ink onto the media in order to facilitate decap of the nozzles. This and other aspects of the examples described herein lower the total cost of operation (TCO) that would otherwise be due to high ink waste experienced during servicing, decap recovery, spit-on-page processes, and lower overall nozzle health, among other disadvantages.

As used in the present specification and in the appended claims, the term "drop weight" is meant to be understood broadly as an amount of jettable material measured in nanograms ejected from a nozzle of a printhead during a firing event of a drop generator. In one example, the jettable material is an ink. The drop weight is proportional to nozzle diameter and resistance area. Thus, drop weight may be increased by increasing nozzle diameter and drop generator (resistor) area. Higher drop weight nozzles arrays are more thermally efficient than lower drop weight nozzles arrays as they require less energy per ejected nanogram of ink and may also deliver higher volumes of ink over their lifetimes. This, in turn, lowers the cost of printing and ownership.

Further, as used in the present specification and in the appended claims, the term "a number of" or similar language is meant to be understood broadly as any positive number comprising 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may not be included in other examples.

Turning now to the figures, FIG. 1 is a diagram of a top view of a fluid ejection assembly (100) including a number of fluid recirculation channels (106), according to one example of the principles described herein. The fluid recirculation channels (106) of FIG. 1, will be described in more detailed with respect to FIG. 3. However, a number of fluid recirculation channels (106) as indicated by dashed box 108 and a number of associated singular nozzle channels (112) are formed within a die (102) of the fluid ejection assembly (100). A fluid slot (104) used to feed jettable material such as ink is also formed within the fluid ejection assembly (100). The slot (104) is fluidically coupled to each of the fluid recirculation channels (106) and each of the singular nozzle channels (112).

The associated singular nozzle channels (112) are not directly fluidically coupled to the fluid recirculation channels (106), but are indirectly fluidically coupled to the fluid recirculation channels (106) due to the associated singular nozzle channels (112) drawing of fluid from the same fluid slot (104). Dashed box 110 provides an example indication as to which fluid recirculation channel (106) one of the singular nozzle channels (112) is associated.

Although five fluid recirculation channels (106) are depicted on each side of the slot (104) (total of ten fluid recirculation channels (106)) and seven associated singular nozzle channels (112) are depicted on each side of the slot (104) (total of fourteen singular nozzle channels (112)), any number or configuration of fluid recirculation channels (106) and singular nozzle channels (112) may be included within a fluid ejection assembly (100). As will be described in more detail below, the order of which the fluid recirculation channels (106) and singular nozzle channels (112) are located on opposite sides of the slot (104) create an effectively higher nozzle density wherein the nozzles within the fluid recirculation channels (106) and singular nozzle channels (112) complement each other and work together to create a higher quality print on a media than could otherwise be achieved in devices that do not utilize the examples described herein. Further, nozzles within the fluid recirculation channels (106) and singular nozzle channels (112) complement each other and work together with respect to additional fluid ejection assemblies (100) arranged within a printhead array as described herein in connection with FIG. 5.

Figure 3:
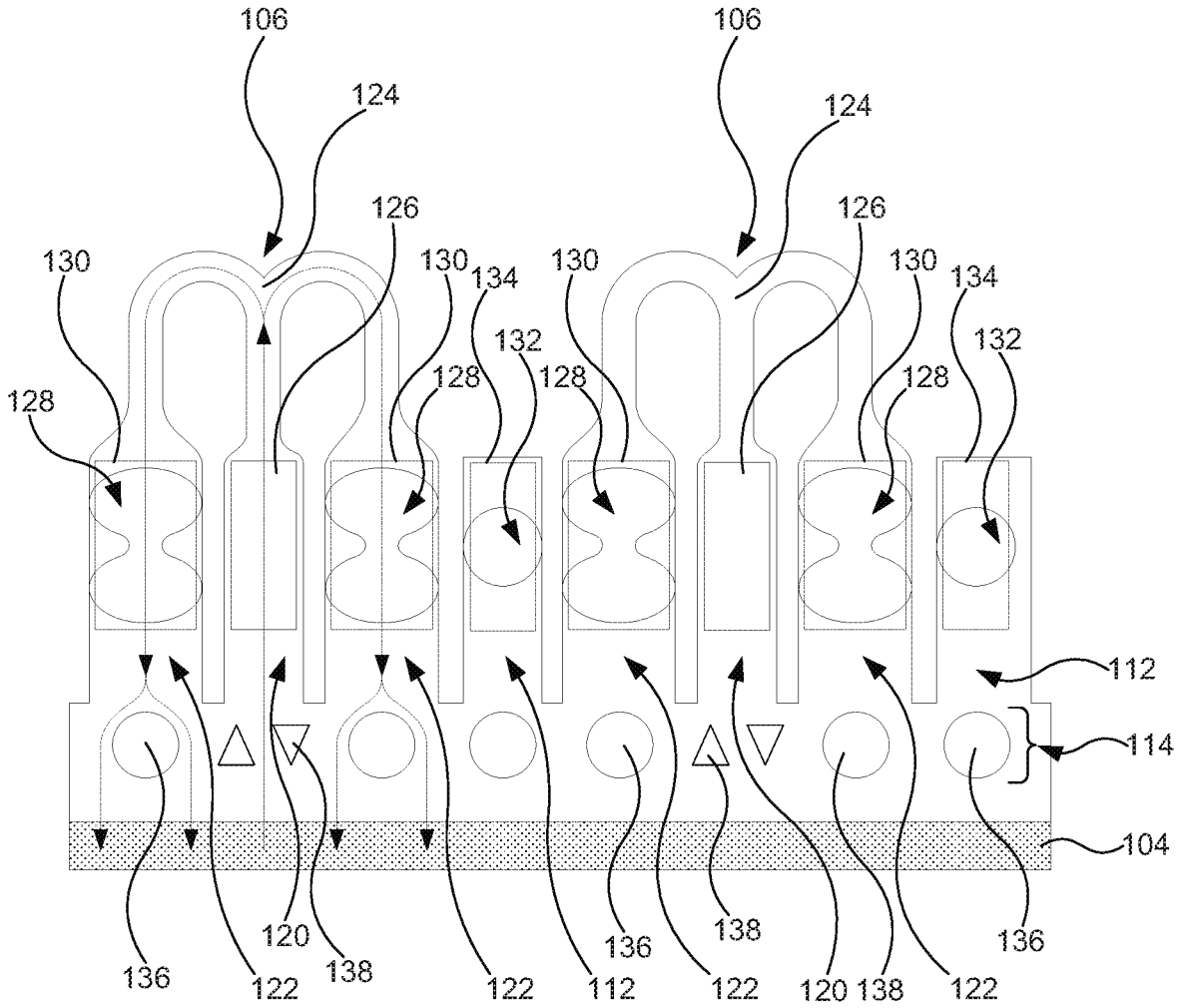
FIG. 3 is a diagram of two fluid recirculation channels depicted in FIG. 1, according to another example of the principles described herein.

While continuing to refer to FIG. 1, FIG. 3 is a diagram of two fluid recirculation channels (106) depicted in FIG. 1, according to another example of the principles described herein. Each of the fluid recirculation channels (106) of the example of FIGS. 1 and 3 include a pump channel (120) fluidically coupled to two drop generator channels (122) via an m-shaped connection channel (124). The singular nozzle channels (112) associated with the fluid recirculation channels (106) are located between the fluid recirculation channels (106).

Each of the pump channels (120) include at least one pump generator (126) depicted in FIGS. 1 and 3 as solid boxes. The terms "pump" and "pump generator" are used interchangeably herein to refer to any device used to move fluid through a pump channel. The pump generators (126) draw jettable material from the fluid slot (104) into their respective pump channels (120), through the m-shaped connection channels (124), into the drop generator channels (122), and back out into the fluid slot (104) as indicated by the dashed arrows depicted within the fluid recirculation channel (106) of FIG. 3. In one example, the pump generators (126) may be thermal resistor elements that move the jettable material through the fluid recirculation channels (106) by excitation of a resistive heating element to create a bubble. In another example, the pump generators (126) may be any of various types of pumping elements that may be suitably deployed within the pump channels (120) of the fluid ejection assembly (100) such as, for example, piezoelectric pumps, electrostatic pumps, and electro hydrodynamic pumps, among other types of pumps. In one example, the pump generators (126) may be split resistive elements wherein the split resistive structure includes two rectangular regions or legs spaced from each other. In this example, electrical energy to produce heating is supplied to the split resistive elements to create a collapsing fluid bubble.

The pump generators (126) of FIGS. 1 and 3 as well as other examples described herein may use any of a number of actuation profiles to initiate and maintain recirculation of the jettable fluid throughout the fluid recirculation channels (106). In one example, the examples described herein may use a micro-recirculation continuous (MRC) actuation profile wherein the pump generators (126) are continuously run after warming up and servicing the nozzles. In this example, the MRC actuation profile may operate at 2 to 500 hertz (Hz.

In another example, a micro-recirculation assisted bursting/embedded stochastic bursting (MAB/ESB) actuation profile may be used by the pump generators (126) wherein periodically short bursts of recirculation pulses are run after warming up and servicing the nozzles. A delay ($\Delta t$) may define the time between the bursts of recirculation pulses from the pump generators (126). Thus, the MAB/ESB actuation profile uses a stochastic bursting pattern.

In still another example, the pump generators (126) may use a micro-recirculation-on-demand/emulation (MOD/e) actuation profile wherein the pump generators (126) are activated to refresh ink within the fluid recirculation channels (106) just before drop ejection on the print media (i.e., printing) takes place. In this example, the MOD/e actuation profile may operate at 2 to 36 kilohertz (kHz) and produce between 100 and 5000 pulses.

In the example of FIGS. 1 and 3, the pump channel (120) is fluidically coupled to two drop generator channels (122) via the m-shaped connection channel (124). The drop generator channels (122) each include at least one nozzle (128) and at least one drop generator (130). The nozzles (128) are apertures defined within the drop generator channels (122) of the fluid recirculation channels (106) of the fluid ejection assembly (100). The drop generators (130) are depicted in FIGS. 1 and 3 as dashed boxes because they are located behind the nozzles (128) of the drop generator channels (122). In one example, the drop generators (130) may include a heating element used in thermal inkjet printheads wherein the heating element generates bubbles within the jettable material by heating up and ejecting the jettable material by utilizing the expansion of the bubbles. In another example, the drop generators (130) may include a piezoelectric drop generator that changes the shape of a piezoelectric material when an electric field is applied. In still another example, the drop generators (130) may include a shape memory alloy that is actuated electrically, wherein an electric current results in Joule heating and deactivation occurs by convective heat transfer to the ambient environment.

In the example of FIGS. 1 and 3, the singular nozzle channels (112) associated with the fluid recirculation channels (106) are fluidically coupled to the fluid slot (104). Each of the singular nozzle channels (112) include at least one nozzle (132) and at least one drop generator (134). The nozzles (132) are apertures defined within the singular nozzle channels (112) of the fluid ejection assembly (100). In one example, the drop generators (134) may include a heating element used in thermal inkjet printheads, a piezoelectric drop generators, or a shape memory alloy, among other types of drop generating elements.

The nozzles (128) of the drop generator channels (122) and the nozzles (132) of the singular nozzle channels (112) may eject different drop weights. In the example of FIGS. 1 and 3, the nozzles (128) of the drop generator channels (122) may include high drop weight nozzles that eject relatively higher drop weights of jettable material as compared to the low drop weight nozzles (132) of the singular nozzle channels (112). In one example, the nozzles (128) of the drop generator channels (122) eject an amount of jettable material that has a drop weight of between 7 and 11 nanograms (ng), while the nozzles (132) of the singular nozzle channels (112) eject an amount of jettable material that has a drop weight of between 2 and 7 ng. In another example, the nozzles (128) of the drop generator channels (122) eject an amount of jettable material that has a drop weight of 9 ng, while the nozzles (132) of the singular nozzle channels (112) eject an amount of jettable material that has a drop weight of 4 ng.

In another example, the nozzles include at least two different nozzles that emit approximately the same drop weights of fluid. In this example, the nozzles may eject an amount of jettable material that has a drop weight of between 2 and 11 ng.

The shapes of the nozzles (128) of the drop generator channels (122) and the nozzles (132) of the singular nozzle channels (112) may also differ. In the example of FIGS. 1 and 3, the nozzles (128) of the drop generator channels (122) include a figure-8-shape that allows for a relatively higher drop weight of jettable material to be ejected therefrom as compared to the circular shape of the relatively smaller nozzles (132) of the singular nozzle channels (112). However, in another example, the shape of the nozzles (128, 132) may be similar but may differ in size in order to achieve the differing drop weights of jettable material ejected therefrom.

The fluid ejection assembly (100) further includes particle tolerant architectures (114) in the form of particle tolerance pillars (136, 138). These particle tolerance pillars (136, 138) may be located on a shelf between the fluid slot (104) and the fluid recirculation channels (106) and singular nozzle channels (112). The particle tolerance pillars (136, 138) may be formed during the fabrication of the fluid ejection assembly (100), and are located on a shelf of inlets of the fluid recirculation channels (106) and singular nozzle channels (112). The particle tolerance pillars (136, 138) help prevent small particles in the jettable material from entering the inlets of the fluid recirculation channels (106) and singular nozzle channels (112) and blocking flow of jettable material to the channels (106, 122). The particle tolerance pillars (136, 138) may be located in the fluid slot (104), adjacent to the fluid recirculation channels (106) and singular nozzle channels (112), or both.

Also formed within the fluid ejection assembly (100) is additional integrated circuitry (140) for selectively activating each pump generator (126) and drop generator (130, 134). The integrated circuitry (140) includes a drive transistor such as a field-effect transistor (FET), for example, associated with each pump generator (126) and drop generator (130, 134). In one example, drop generator (130, 134) may have a dedicated drive transistor to enable individual activation of each drop generator (130, 134), each pump generator (126) may not have a dedicated drive transistor because the pump generators (126), in some examples, may not be activated individually. Rather, a single drive transistor may be used to power a group of pump generators (126) simultaneously. Accordingly, the drop generator (130, 134) and pump generator (126) arrangement depicted in the fluid ejection assembly (100) of FIG. 1 may implement as few as thirty-five drive transistors, or in an extreme case, as many as forty-four drive transistors. In the latter case, FETs of different size that may take up different amounts of space on the substrate may be used. For example, smaller FETs may be used for the pump generators (126), while larger FETs may be used for the drop generators (130, 134).

In the examples described herein, the nozzle density of the fluid ejection assembly (100) may be based on a number of properties of the fluid ejection assembly (100) and is at least partially attributed to the characteristics of the high density silicon platform (HD Si) used therein. These properties include (1) the density of drive transistors (i.e., the FETs) within the system that utilizes the fluid ejection assembly (100); (2) the physical layout of high drop weight and low drop weight nozzles within the fluid ejection assembly (100) per slot inch of the fluid ejection assembly (100); and (3) the nozzle pitch within the fluid ejection assembly (100) which may be defined as the distance between centers of neighboring nozzles, among other properties. In one example, using the HD Si described in connection with the examples herein with 2400 FET transistors per fluid slot (104) enables high nozzle density of at least 1800 npsi at a 1200 dots per inch (dpi) nozzle pitch. At the same time, this example may deliver high ink flow due to the fluid recirculation channels (106), and provide dual drop weight capability due to the different sizes of the nozzles (128, 132) within the fluid recirculation channels (106) and singular nozzle channels (112). These aspects of the examples described herein provide for high image print quality (IPQ), and enable decap recovery and jettability of even water based UV curable inks with very high solids load of up to 30 percent by volume.

The dimensions of the pump channels (120), drop generator channels (122), m-shaped connection channels (124), pump generators (126), nozzles (128, 132), and drop generators (130, 134) of FIGS. 1 and 3 will now be described. The pump channels (120) may be between 5 and 16 micrometers (μm) in width. The drop generator channels (122) may be between 5 and 16 μm in width. The width of the pump generators (126) may be between 2 and 12 μm, with a length of between 0-75 μm. In one example, the pump generators (126) may include a width of 11 μm and a length of 29 μm. The drop generators (130, 134) may have similar dimensions as the pump generators (126).

The m-shaped connection channels (124) may be between 5 and 15 μm in width. The m-shaped connection channels (124) may be between 20 and 30 μm in length. In one example, the m-shaped connection channels (124) may be 25 μm in length. Further, in one example, the m-shaped connection channels (124) may be 7 μm in width. In another example, the m-shaped connection channels (124) may be 10 μm in width. In still another example, the m-shaped connection channels (124) may be 13 μm in width. In the examples of the m-shaped connection channels (124), the m-shaped connection channels (124) may include cross sectional shapes that are square, rounded, elliptical, or other shapes. Round cross-sectional shapes of the m-shaped connection channels (124) provides for a reduction or elimination of stagnation of flow in tight corners that stimulate potential ink crashing and air bubble accumulation that may occur in, for example, m-shaped connection channels (124) with square or cross-sectional shapes. Although m-shaped connection channels (124) are described in connection with FIGS. 1, 3, and 5 herein as one example, the connection channels may include any shape as long as the connection channels provide fluidic connection between pump channels and drop generator channels.

The nozzles (128) of the drop generator channels (122) associated with the drop generator (130) may have a non-circular bore (NCB) that is, for example, symmetric in both an x and y direction. The nozzles (128) of the drop generator channels (122) may have two halves or lobes as depicted in FIGS. 1 and 3 that are between 15 and 18 μm in width and between 12 and 18 μm in length making the nozzles (128) of the drop generator channels (122) have between 24 and 39 μm in length. In one example, the lobes of the NCB of the nozzles (128) of the drop generator channels (122) may have a width of approximately 15 μm and the total length of the nozzles (128) may be approximately 28 μm.

The nozzles (132) of the singular nozzle channels (112) may have a diameter of between 12 and 16 μm. In another example, the nozzles (132) of the singular nozzle channels (112) may have a diameter of approximately 14.5 μm.

The drop generators (130) of the drop generator channels (122) may have a width of approximately 16 μm and a length of approximately 29 μm. The drop generators (134) of the singular nozzle channels (112) may have a width of approximately 11 μm and a length of approximately 29 μm.

Turning again to FIGS. 1 and 3, the fluid recirculation channels (106) within the examples of FIGS. 1 and 3 may be classified as a 2:1 drop generator to pump generator ratio. Throughout the examples described herein, the fluid recirculation channels (106) include an N:1 drop generator to pump generator ratio, wherein N is at least 1. In other examples, N is at least 2. In still other examples, N is at least 3. In another example, different fluid recirculation channels with different N:1 drop generator to pump generator ratios may be included within a fluid ejection assembly (100). In this example, a number of 1:1 drop generator to pump generator ratio fluid recirculation channels may be separated by a number of 2:1 or 3:1 drop generator to pump generator ratio fluid recirculation channels. Another example of a fluid ejection assembly will now be described in connection with FIGS. 2 and 4.

In other examples described herein in connection with FIGS. 1 through 7, the fluid recirculation channels may utilize more than a single pump generator within any example. For example, two or more pump generators may be present in a single pump channel or a plurality of pump channels. Further, in the example described herein, the fluid recirculation channels may include an N:P ratio (nozzle-to-pump ratio) where both N and P are at least one. For example, the N:P ratio in one example may be 1:1, 2:1, 3:1, 4:2, 5:2, etc. In another example, N:P ratio may be defined as N being at least 2 and P being at least 2. For example, the N:P ratio in this example may be 2:2, 3:2, 4:2, 5:2, 6:2, 6:3, 6:4, etc.

Figure 2:
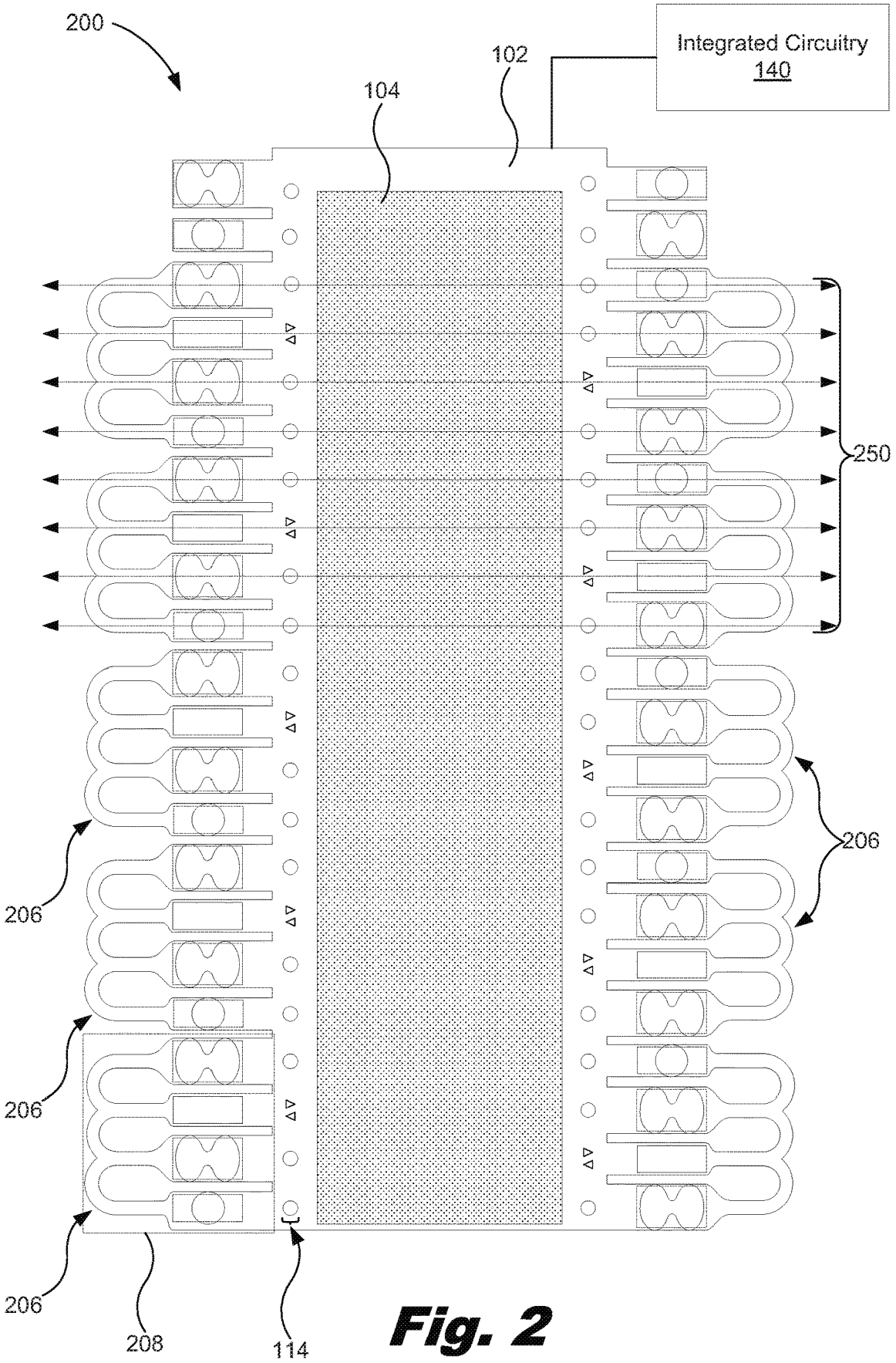
FIG. 2 is a diagram of a top view of a fluid ejection assembly including a number of fluid recirculation channels, according to another example of the principles described herein.

FIG. 2 is a diagram of a top view of a fluid ejection assembly (200) including a number of fluid recirculation channels (206), according to another example of the principles described herein. Similar elements are similarly numbered within FIGS. 2 and 4 with respect to FIGS. 1 and 3. However, the example fluid ejection assembly (200) including the fluid recirculation channels (206) differs from the example in FIGS. 1 and 3 in that the example of FIGS. 2 and 4 includes fluid recirculation channels (206) that have a 2:1 drop generator to pump generator ratio. Thus, the example fluid recirculation channels (206) do not include associated singular nozzle channels (112) as does the example of FIGS. 1 and 3. Instead, the associated singular nozzle channels (212) are fluidically coupled to the fluid recirculation channels (206) via the three-loop connection channel (224).

To distinguish the elements of the drop generator channels (222) and the associated singular nozzle channels are (212), they will be referred to as high drop weight (HDW) drop generator channels (222) and low drop weight (LDW) drop generator channels (212). A number of fluid recirculation channels (206) indicated by dashed box 208 are formed within a die (102) of the fluid ejection assembly (200) similar to the example of FIGS. 1 and 3. A fluid slot (104) used to feed jettable material such as ink is also formed within the fluid ejection assembly (200). The slot (104) is fluidically coupled to each of the fluid recirculation channels (206). Although five fluid recirculation channels (206) are depicted on each side of the slot (104) (total of ten fluid recirculation channels (206)), any number or configuration of fluid recirculation channels (206) may be included within a fluid ejection assembly (200). As will be described in more detail below, the order of which the fluid recirculation channels (206) are located on opposite sides of the slot (104) create an effectively higher nozzle density wherein the nozzles within the fluid recirculation channels (206) complement each other and work together to create a higher quality print on a media than could otherwise be achieved in devices that do not utilize the examples described herein. Further, nozzles within the fluid recirculation channels (206) complement each other and work together with respect to additional fluid ejection assemblies (200) arranged within a printhead array as described herein in connection with FIG. 6.

Figure 4:
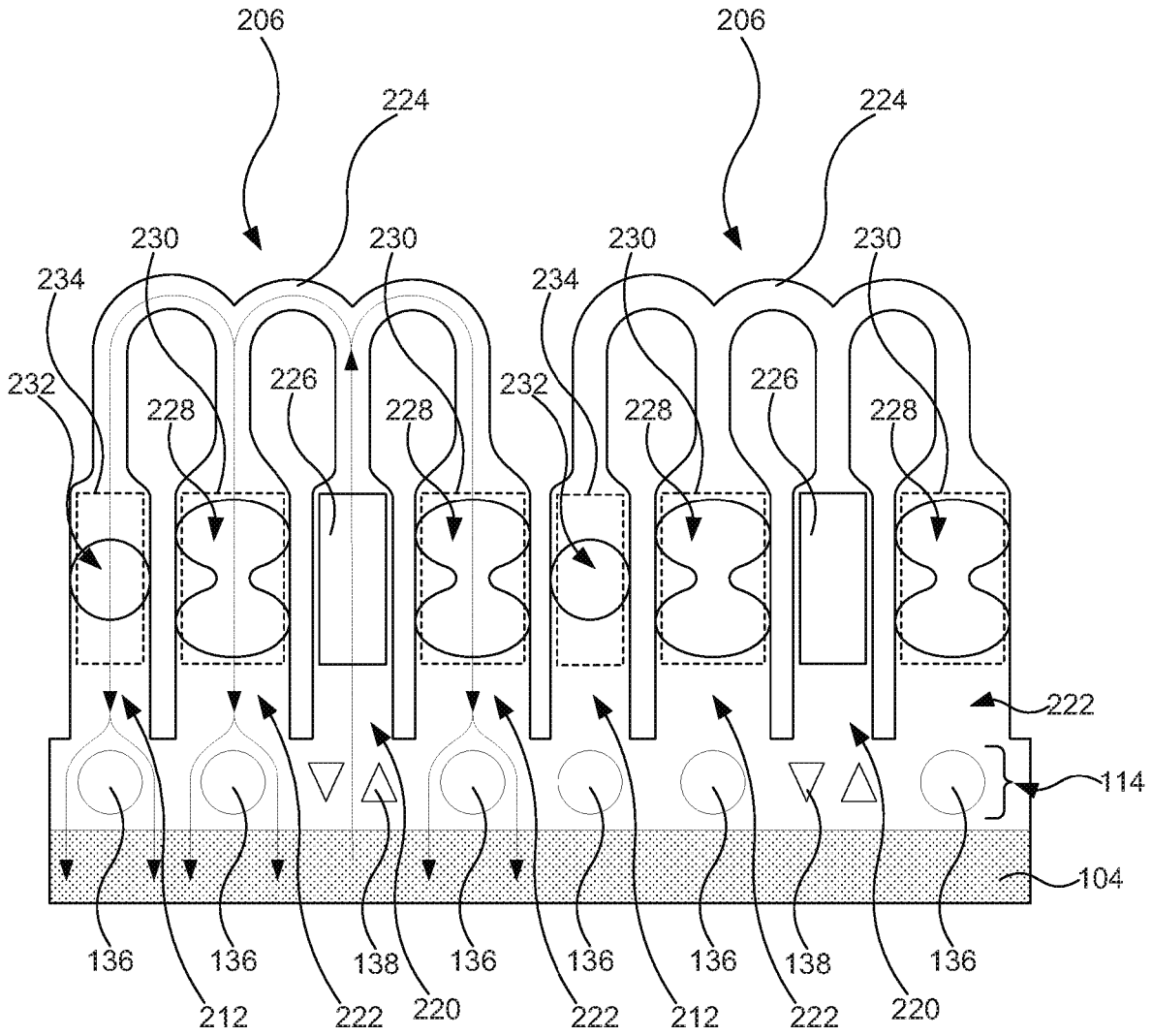
FIG. 4 is a diagram of two fluid recirculation channels depicted in FIG. 2, according to another example of the principles described herein.

While continuing to refer to FIG. 2, FIG. 4 is a diagram of two fluid recirculation channels (206) depicted in FIG. 2, according to another example of the principles described herein. Each of the fluid recirculation channels (206) of the example of FIGS. 2 and 4 include a pump channel (220) fluidically coupled to the HDW drop generator channels (222) and LDW drop generator channel (212) via the three-loop connection channel (224).

Each of the pump channels (220) include a pump generator (226) depicted in FIGS. 2 and 4 as solid boxes. The pump generators (226) draw jettable material from the fluid slot (104) into their respective pump channels (220), through the three-loop connection channel (224), into the drop generator channels (212, 222), and back out into the fluid slot (104) as indicated by the dashed arrows depicted within the fluid recirculation channel (206) of FIG. 4. As similarly described above in connection with FIGS. 1 and 3, the pump generators (226) may be any of various types of pumping elements that may be suitably deployed within the pump channels (220) of the fluid ejection assembly (200) such as, for example, thermal resistor pumps, piezoelectric pumps, electrostatic pumps, and electro hydrodynamic pumps, among other types of pumps.

In the example of FIGS. 2 and 4, the pump channel (220) is fluidically coupled to the drop generator channels (212, 222) via the three-loop connection channel (224). The drop generator channels (212, 222) each include at least one nozzle (228, 232) and at least one drop generator (230, 234). The nozzles (228, 232) are apertures defined within the drop generator channels (212, 222) of the fluid recirculation channels (206) of the fluid ejection assembly (200). The drop generators (230, 234) are depicted in FIGS. 2 and 4 as dashed boxes because they are located behind the nozzles (228, 232) of the drop generator channels (212, 122). In one example, the drop generators (230, 234) may include a heating element used in thermal inkjet printheads, a piezoelectric, and a shape memory, among other types of drop generators (230, 234).

The nozzles (228, 232) of the drop generator channels (212, 122) may eject different drop weights as similarly described above in connection with FIGS. 1 and 3. Thus, in the example of FIGS. 2 and 4, the nozzles (228) of the HDW drop generator channels (222) may include high drop weight nozzles that eject relatively higher drop weights of jettable material as compared to the low drop weight nozzles (232) of the LOW drop generator channels (212). In one example, the nozzles (228) of the HDW drop generator channels (222) eject an amount of jettable material that has a drop weight of between 7 and 11 nanograms (ng), while the nozzles (232) of the LDW drop generator channels (212) eject an amount of jettable material that has a drop weight of between 2 and 7 ng. In another example, the nozzles (228) of the HDW drop generator channels (222) eject an amount of jettable material that has a drop weight of 9 ng, while the nozzles (232) of the LDW drop generator channels (212) eject an amount of jettable material that has a drop weight of 4 ng.

The shapes of the nozzles (228, 232) may also differ as similarly described above in connection with FIGS. 1 and 3. In the example of FIGS. 2 and 4, the nozzles (228) of the HDW drop generator channels (222) include a figure-8-shape that allows for a relatively higher drop weight of jettable material to be ejected therefrom as compared to the circular shape of the relatively smaller nozzles (232) of the LDW drop generator channels (212). However, in another example, the shape of the nozzles (228, 232) may be similar but may differ in size in order to achieve the differing drop weights of jettable material ejected therefrom.

The fluid ejection assembly (200) further includes particle tolerant architectures (114) in the form of particle tolerance pillars (136, 138) as similarly described above in connection with FIGS. 1 and 3. These particle tolerance pillars (136, 138) include the same properties as those described above in connection with FIGS. 1 and 3. Also formed within the fluid ejection assembly (200) is additional integrated circuitry (140) for selectively activating each pump generator (226) and drop generator (230, 234) as similarly described above in connection with FIGS. 1 and 3. Thus, the integrated circuitry (140) includes a drive transistor such as a field-effect transistor (FET) with the above-described properties.

In the examples described herein, the nozzle density of the fluid ejection assembly (200) may be based on a number of properties of the fluid ejection assembly (200) and is at least partially attributed to the characteristics of the high density silicon platform (HD Si) used therein as similarly described above in connection with FIGS. 1 and 3.

The dimensions of the pump channels (220), drop generator channels (212, 222), three-loop connection channel (224), pump generators (226), nozzles (228, 232), and drop generators (230, 234) of FIGS. 2 and 4 are similar to those described above in connection with FIGS. 1 and 3. Turning again to FIGS. 2 and 4, the fluid recirculation channels (206) within the examples of FIGS. 2 and 4 may be classified as a 3:1 drop generator to pump generator ratio.

Figure 5:
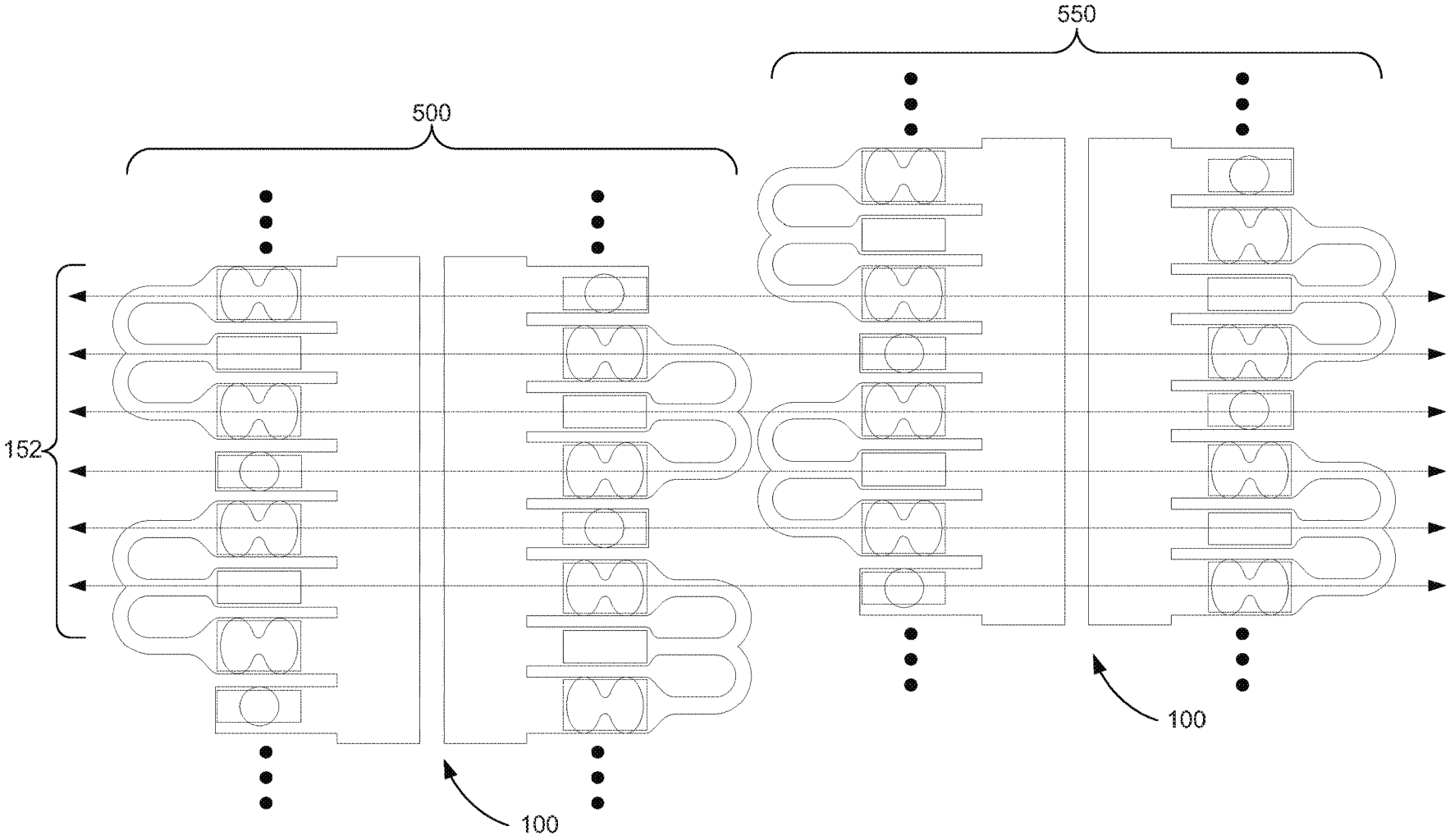
FIG. 5 is a diagram of the fluid ejection assembly of FIG. 1 within an array of printheads, according to another example of the principles described herein.

FIG. 5 is a diagram of the fluid ejection assembly (100) of FIG. 1 within an array of printheads (500, 550), according to another example of the principles described herein. Alignment of HDW nozzles (128), LDW nozzles (132), and pumps (126) with respect to opposing banks within a single fluid ejection assembly (100) and with respect to different printheads provides for a relatively higher effective nozzle density without physical inclusion of smaller or more abundant nozzles per slot inch. The ellipses depicted in FIG. 5 indicate that additional elements may be added in the order described below to provide a wider printhead.

As depicted in FIG. 5, the two fluid ejection assemblies (100) of FIGS. 1 and 3 form a first printhead (500), and two fluid ejection assemblies (100) form a second printhead (550). The order of the elements within the example rows (150) are listed in the below table. This arrangement of HDW nozzles (128), LDW nozzles (132), and pumps (126) of the fluid ejection assemblies (100) is an example, and other arrangements may be contemplated to achieve the same goal of a relatively higher effective nozzle density.

TABLE 1

| Order of elements within example of FIG. 1, H = HDW nozzles (128), L = LDW nozzles (132), and P = pumps (126) | |
|---|---|
| Left-Side Bank | Right-Side Bank |
| H | L |
| P | H |
| H | P |
| L | H |
| H | L |
| P | H |
| H | P |
| L | H |

Thus, when the first printhead (500), and the second printhead (550) are utilized in tandem within a printing device, the arrangement of HDW nozzles (128), LDW nozzles (132), and pumps (126) of the fluid ejection assemblies (100) may be arranged as indicated by rows (152):

TABLE 2

| Order of elements within example of FIG. 5, H = HDW nozzles (128), L = LDW nozzles (132), and P = pumps (126) (last two rows extrapolated) | | | |
|---|---|---|---|
| First Printhead (500) | | Second Printhead (550) | |
| Left-Side Bank | Right-Side Bank | Left-Side Bank | Right-Side Bank |
| H | L | H | P |
| P | H | L | H |
| H | P | H | L |
| L | H | P | H |
| H | L | H | P |
| P | H | L | H |

TABLE 2-continued

| Order of elements within example of FIG. 5, H = HDW nozzles (128), L = LDW nozzles (132), and P = pumps (126) (last two rows extrapolated) | | | |
|---|---|---|---|
| First Printhead (500) | | Second Printhead (550) | |
| Left-Side Bank | Right-Side Bank | Left-Side Bank | Right-Side Bank |
| H | P | H | L |
| L | H | P | H |

Figure 6:
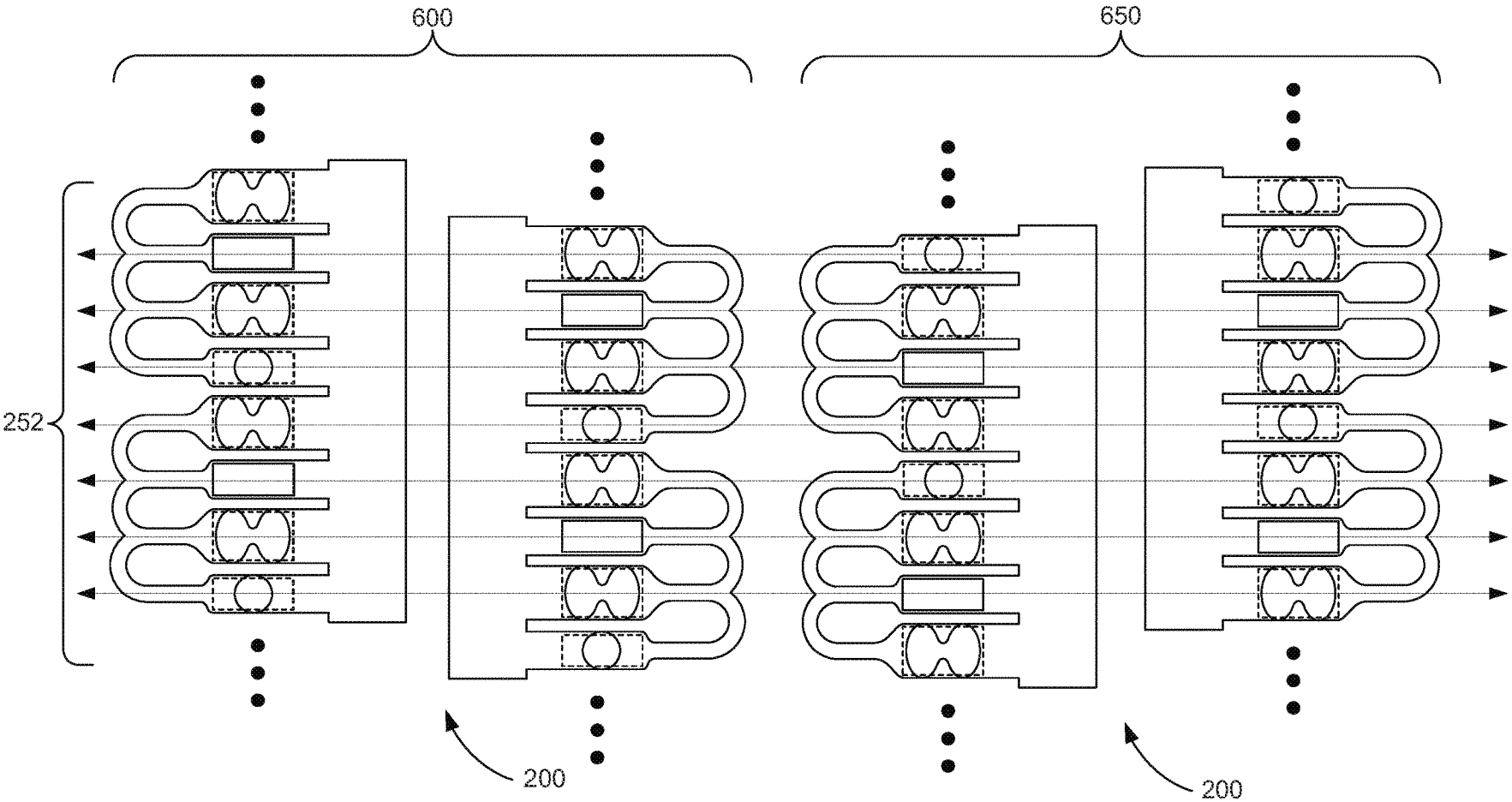
FIG. 6 is a diagram of the fluid ejection assembly of FIG. 2 within an array of printheads, according to another example of the principles described herein.

FIG. 6 is a diagram of the fluid ejection assembly (200) of FIG. 2 within an array of printheads (600, 650), according to another example of the principles described herein. Alignment of HDW nozzles (228), LDW nozzles (232), and pumps (226) with respect to opposing banks within a single fluid ejection assembly (200) and with respect to different printheads provides for a relatively higher effective nozzle density without physical inclusion of smaller or more abundant nozzles per slot inch. Again, the ellipses depicted in FIG. 6 indicate that additional elements may be added in the order described below to provide a wider printhead.

As depicted in FIG. 6, the two fluid ejection assemblies (200) of FIGS. 2 and 4 form a first printhead (600), and two fluid ejection assemblies (200) form a second printhead (650). The order of the elements within the example rows (250) are listed in the below table. This arrangement of HDW nozzles (228), LDW nozzles (232), and pumps (226) of the fluid ejection assemblies (200) is an example, and other arrangements may be contemplated to achieve the same goal of a relatively higher effective nozzle density.

TABLE 3

| Order of elements within example of FIG. 2, H = HDW nozzles (228), L = LDW nozzles (232), and P = pumps (226) | |
|---|---|
| Left-Side Bank | Right-Side Bank |
| H | L |
| P | H |
| H | P |
| L | H |
| H | L |
| P | H |
| H | P |
| L | H |

Thus, when the first printhead (600), and the second printhead (650) are utilized in tandem within a printing device, the arrangement of HDW nozzles (228), LDW nozzles (232), and pumps (226) of the fluid ejection assemblies (200) may be arranged as indicated by rows (252):

TABLE 2

| Order of elements within example of FIG. 6, H = HDW nozzles (228), L = LDW nozzles (232), and P = pumps (226) (rows extrapolated) | | | |
|---|---|---|---|
| First Printhead (600) | | Second Printhead (650) | |
| Left-Side Bank | Right-Side Bank | Left-Side Bank | Right-Side Bank |
| H | L | H | L |
| P | H | L | H |
| H | P | H | P |
| L | H | P | H |
| H | L | H | L |
| P | H | L | H |

TABLE 2-continued

| Order of elements within example of FIG. 6, H = HDW nozzles (228), L = LDW nozzles (232), and P = pumps (226) (rows extrapolated) | | | |
|---|---|---|---|
| First Printhead (600) | | Second Printhead (650) | |
| Left-Side Bank | Right-Side Bank | Left-Side Bank | Right-Side Bank |
| H | P | H | P |
| L | H | P | H |

Figure 7:
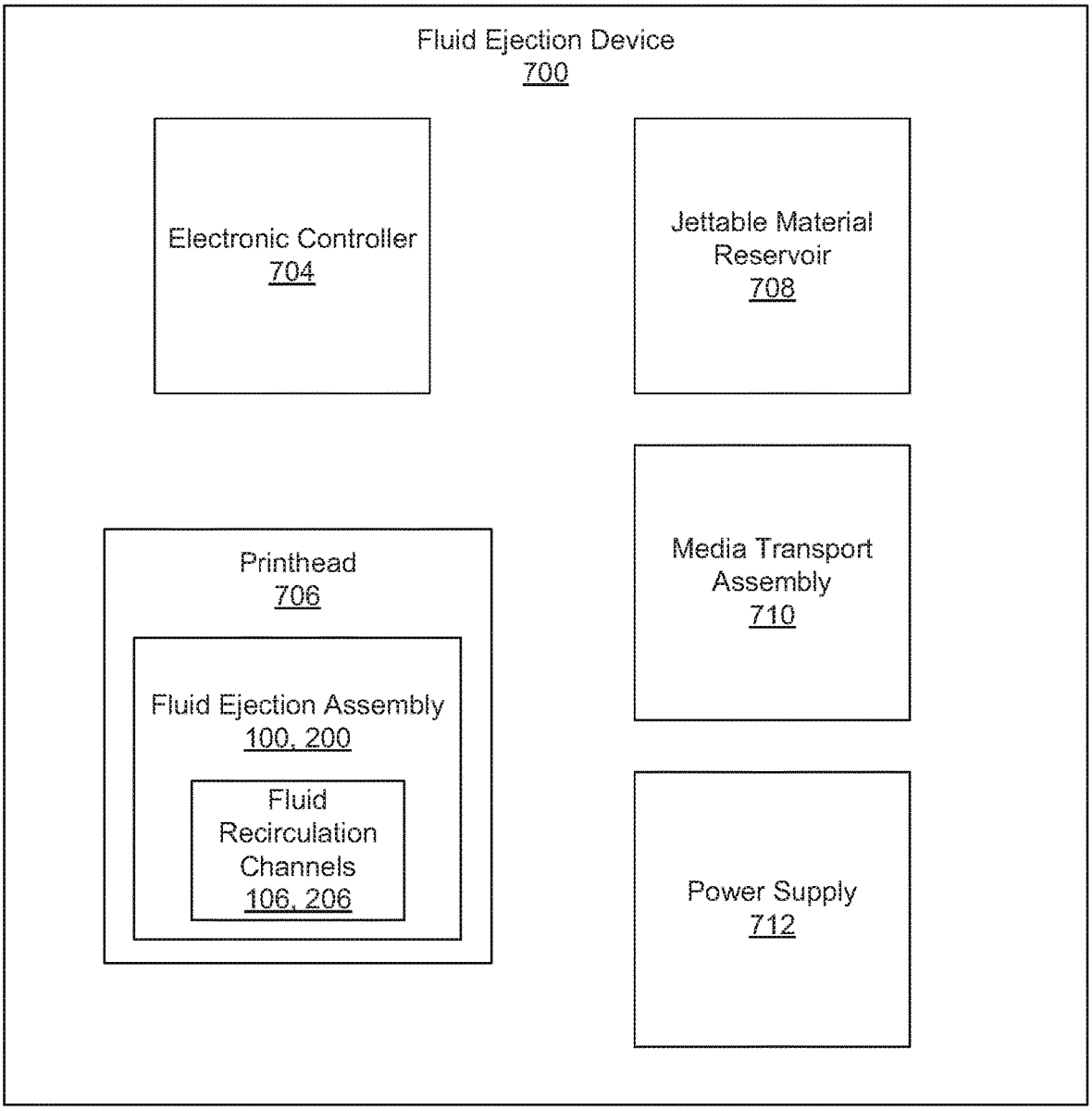
FIG. 7 is a block diagram of a fluid ejection device including the fluid ejection assemblies of FIG. 1 or 2, according to one example of the principles described herein.

FIG. 7 is a block diagram of a fluid ejection device (700) including the fluid ejection assemblies (100, 200) of FIG. 1 or 2, according to one example of the principles described herein. The fluid ejection device (700) includes an electronic controller (704) and the fluid ejection assembly (100, 200) within at least one printhead (706). The fluid ejection assembly (100, 200) may include the fluid recirculation channels (106, 206). The fluid ejection assembly (100, 200) may be any example fluid ejection assembly described, illustrated, and/or contemplated by the present disclosure. The fluid ejection assembly (100, 200) may include the fluid recirculation channels (106, 206) described herein.

The electronic controller (704) may include a processor, firmware, and other electronics for communicating with and controlling the integrated circuitry (140) and fluid ejection assembly (100, 200) in order to eject fluid droplets in a precise manner. The electronic controller (704) receives data from a host system, such as a computer. The data represents, for example, a document and/or file to be printed and forms a print job that includes at least one print job commands and/or command parameters. From the data, the electronic controller (704) defines a pattern of drops to eject which form characters, symbols, and/or other graphics or images.

In one example, the fluid ejection device (700) may be an inkjet printing device. In this example, the fluid ejection device (700) may further include a fluidically coupled jettable material reservoir (708) fluidically coupled to the fluid recirculation channels (106, 206) of the fluid ejection assembly (100, 200) to supply jettable material thereto.

A media transport assembly (710) may be included in the fluid ejection device (700) to provide media for the fluid ejection device (700) in order to create images on the media via ejection of the jettable material from the fluid recirculation channels (106, 206). The fluid ejection device (700) may further include a power supply (712) to power the various electronic elements of the fluid ejection device (700).

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general purpose computer, special purpose computer, or other programmable data processing apparatus to produce a machine, such that the computer usable program code, when executed via, for example, the electronic controller (704) of the fluid ejection device (700) or other programmable data processing apparatus, implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

The specification and figures describe a fluid recirculation channel for dispensing a plurality of fluid drop weights includes a number of sub-channels. The sub-channels include at least one pump channel, and a plurality of drop generator channels fluidically coupled to the at least one pump channel. The fluid recirculation channel further includes a number of pump generators incorporated into the at least one pump channel, a number of drop generators incorporated into drop generator channels, and a plurality of nozzles defined within the drop generator channels, the nozzles being at least as numerous as the number of drop generators. The nozzles include at least two different nozzles that emit at least two different drop weights of fluid, the two different drop weights comprising a first drop weight and a second drop weight, the second drop weight comprising a drop weight that is relatively higher than the first drop weight.

The fluid recirculation channels described herein may have a number of advantages, including: (1) overcoming low ink flux issues and enable 25-50 percent higher ink flux of decap susceptible inks; (2) allowing for inks that include high solid loads such as ultraviolet (UV) curable inks to be used within the printheads; (3) overcoming decap issues that may arise due to PIVS and the formation of viscous plugs within the printheads and nozzles; (4) reducing or eliminating the need for ink spitting used to decap the nozzles in preparation for printing; (5) providing a relatively shorter decap time of high solid load inks; (6) significantly lowering the decap time for even high solid load inks eliminating the need for ink spitting for decap recovery purposes (7) allowing for the use of high efficiency inks within the printing system and allowing the use of a wider array of printing scenarios and in connection with a wider array of ink types, and, in turn, allowing use by a larger number of customers desiring high quality printing; (8) providing a higher ink efficiency by not requiring ink spitting during servicing before and during operation; (9) reducing or eliminating ink spitting on the media; and (10) lowering the total cost of operation that would otherwise be due to high ink waste experienced during servicing, decap recovery, spit-on-page processes, and lower overall nozzle health, among other disadvantages.

The preceding description has been presented to illustrate and describe examples of the principles described. This description is not intended to be exhaustive or to limit these principles to any precise form disclosed. Many modifications and variations are possible in light of the above teaching.

What is claimed is:

1. A fluid ejection device comprising:

a first fluid ejection assembly comprising a fluid feed slot, a first fluid recirculation channel and a second fluid recirculation channel on an opposing side of the fluid feed slot, each fluid recirculation channel comprising:

a pump channel fluidly coupled with the fluid slot;

a pump incorporated into the pump channel;

a plurality of drop generator channels fluidically coupled to the pump channel and the fluid feed slot;

a plurality of drop generators incorporated into the plurality of drop generator channels; and a plurality of nozzles defined within the plurality of drop generator channels, wherein the plurality of nozzles include a first low drop weight nozzle and a first high drop weight nozzle;

wherein the first low drop weight nozzle is a smaller size than the first high drop weight nozzle;

wherein the first high drop weight nozzle of the first fluid recirculation channel is aligned along a first axis across the fluid feed slot from the pump of the second fluid recirculation channel;

wherein the first high drop weight nozzle is adjacent a second pump on a first side and the first low drop weight nozzle on a second side, wherein the first high drop weight nozzle, the second pump, and the first low drop weight nozzle are aligned along a second axis perpendicular to the first axis;

a second fluid ejection assembly including a second high drop weight nozzle and a second low drop weight nozzle, wherein the first high drop weight nozzle and the pump of the second fluid recirculation channel of the first fluid ejection assembly are further aligned along the first axis with the second high drop weight nozzle and the second low drop weight nozzle of the second fluid ejection assembly.

2. The fluid ejection device of claim 1, wherein two of the plurality of drop generator channels of the fluid ejection assembly flank the pump channel of the fluid ejection assembly.

3. The fluid ejection device of claim 2, wherein the first fluid ejection assembly comprises a third fluid recirculation channel that is aligned along the second axis with the first fluid recirculation channel.

4. The fluid ejection device of claim 3, wherein the third fluid recirculation channel includes a plurality of nozzles and a third pump;

wherein the plurality of nozzles include a third low drop weight nozzle and a third high drop weight nozzle;

wherein the third high drop weight nozzle, the third pump, and the third low drop weight nozzle are aligned along the second axis.

5. A printer having a printhead array, the printhead array comprising:

a first printhead comprising a fluid feed slot, a first fluid recirculation channel and a second fluid recirculation channel on an opposing side of the fluid feed slot, each fluid recirculation channel comprising:

a pump channel fluidly coupled with the fluid slot;

a pump incorporated into the pump channel;

a plurality of drop generator channels fluidically coupled to the pump channel and the fluid feed slot;

a plurality of drop generators incorporated into the plurality of drop generator channels; and a plurality of nozzles defined within the plurality of drop generator channels, wherein the plurality of nozzles include a first low drop weight nozzle and a first high drop weight nozzle;

wherein the first low drop weight nozzle is a smaller size than the first high drop weight nozzle;

wherein the first high drop weight nozzle of the first fluid recirculation channel is aligned along a first axis across the fluid feed slot from the pump of the second fluid recirculation channel;

wherein the first high drop weight nozzle is adjacent a second pump on a first side and the first low drop weight nozzle on a second side, wherein the first high drop weight nozzle, the second pump, and the first low drop weight nozzle are aligned along a second axis perpendicular to the first axis;

a second printhead including a second high drop weight nozzle and a second low drop weight nozzle, wherein the first high drop weight nozzle and the pump of the second fluid recirculation channel of the first printhead are further aligned along the first axis with the second high drop weight nozzle and the second low drop weight nozzle of the second printhead.

6. The printer having a printhead array of claim 5, wherein two of the plurality of drop generator channels of the fluid ejection assembly flank the pump channel of the fluid ejection assembly.

7. The printer having a printhead array of claim 5, wherein the first fluid ejection assembly comprises a third fluid recirculation channel that is aligned along the second axis with the first fluid recirculation channel.

8. The printer having a printhead array of claim 7, wherein the third fluid recirculation channel includes a plurality of nozzles and a third pump;

wherein the plurality of nozzles include a third low drop weight nozzle and a third high drop weight nozzle;

wherein the third high drop weight nozzle, the third pump, and the third low drop weight nozzle are aligned along the second axis.

9. The printer having a printhead array of claim 5, wherein the pump is a first pump of a plurality of pumps and the pump channel is a first pump channel of a plurality of pump channels, and wherein a ratio of the plurality of pumps to the plurality of pump channels is 1:1.

10. The printer having a printhead array of claim 5, wherein the first high drop weight nozzle is a figure-eight shape.

11. The fluid ejection device of claim 1, wherein the pump is a first pump of a plurality of pumps and the pump channel is a first pump channel of a plurality of pump channels, and wherein a ratio of the plurality of pumps to the plurality of pump channels is 1:1.

12. The fluid ejection device of claim 5, wherein the first high drop weight nozzle is a figure-eight shape.

13. The fluid ejection device of claim 1, wherein the first high drop weight nozzle is a figure-eight shape.

* * * * *